US012623267B2

(12) United States Patent
Utsunomiya et al.

(10) Patent No.: US 12,623,267 B2
(45) Date of Patent: May 12, 2026

(54) ROLLING STATE OBSERVATION APPARATUS AND ROLLING STATE OBSERVATION METHOD

(71) Applicant: OSAKA UNIVERSITY, Suita (JP)

(72) Inventors: Hiroshi Utsunomiya, Suita (JP); Koji Ono, Suita (JP); Ryo Matsumoto, Suita (JP); Yutaka Yabuta, Suita (JP)

(73) Assignee: OSAKA UNIVERSITY, Osaka (JP)

( * ) Notice: Subject to any disclaimer, the term of this patent is extended or adjusted under 35 U.S.C. 154(b) by 287 days.

(21) Appl. No.: 18/290,489

(22) PCT Filed: May 10, 2022

(86) PCT No.: PCT/JP2022/019804

§ 371 (c)(1),
(2) Date: Nov. 14, 2023

(87) PCT Pub. No.: WO2022/244652

PCT Pub. Date: Nov. 24, 2022

(65) Prior Publication Data

US 2024/0253102 A1 Aug. 1, 2024

(30) Foreign Application Priority Data

May 18, 2021 (JP) ..... 2021-083743

(51) Int. Cl.

| | |
|---|---|
| ***B21B 38/00*** | (2006.01) |
| ***B21B 38/08*** | (2006.01) |
| ***B21C 51/00*** | (2006.01) |

(52) U.S. Cl.
CPC ..... *B21B 38/00* (2013.01); *B21B 38/08* (2013.01); *B21C 51/00* (2013.01)

(58) Field of Classification Search
CPC ..... B21B 27/02; B21B 38/00; B21B 38/08; B21C 51/00
See application file for complete search history.

(56) References Cited

FOREIGN PATENT DOCUMENTS

| | | | |
|---|---|---|---|
| JP | 10-325796 A | | 12/1998 |
| JP | H10325796 A | * | 12/1998 |

OTHER PUBLICATIONS

Translation of JP-H10325796.*

(Continued)

*Primary Examiner* — Bobby Yeonjin Kim
(74) *Attorney, Agent, or Firm* — Birch, Stewart, Kolasch & Birch, LLP

(57) ABSTRACT

Provided are a rolling observation technique whereby the state of rolling on a rolling interface between a material to be processed and a roll can be observed easily and on site; a rolling state observation apparatus for observing the state of rolling at the rolling interface between a material to be processed and a roll during rolling of the material to be processed using two rolls, wherein the two rolls are constituted from a stationary fixed roll and a moving roll that rotates on its own axis while revolving around the fixed roll, and a device for observing the rolling state is provided to the fixed roll; and a rolling state observation apparatus comprising a revolution means for causing the moving roll to revolve around the fixed roll with the center axis of the fixed roll as the rotation center, and a rotation means for causing the moving roll to rotate on its own axis, the rolling state observation apparatus being configured so that the moving roll rotates on its own axis due to the revolution of the moving roll caused by the revolution means.

20 Claims, 9 Drawing Sheets

(56) References Cited

OTHER PUBLICATIONS

Ike et al., "Consideration of Lubricant Behavior by Direct Observation of Plate Rolling Interface", Proceedings of 48th Japanese Joint Conference for the Technology of Plasticity, 1997, pp. 315-316.
Ike et al., "In situ Observation of a Rolling Interface and Modeling of the Surface Texturing of Rolled Sheets", Wear, 2002, vol. 252, pp. 48-62.
International Search Report for PCT/JP2022/019804 mailed on Jun. 21, 2022.
Written Opinion of the International Searching Authority for PCT/JP2022/019804 mailed on Jun. 21, 2022.
Yasuda, "Measurement of Streamlines by Direct Observation of the Surface of Plasticine Rolled Plate using Transparent Rolls", Proceedings of 66th Japanese Joint Conference for the Technology of Plasticity, 1997, pp. 345-346.

* cited by examiner

[Fig.1]
(a)
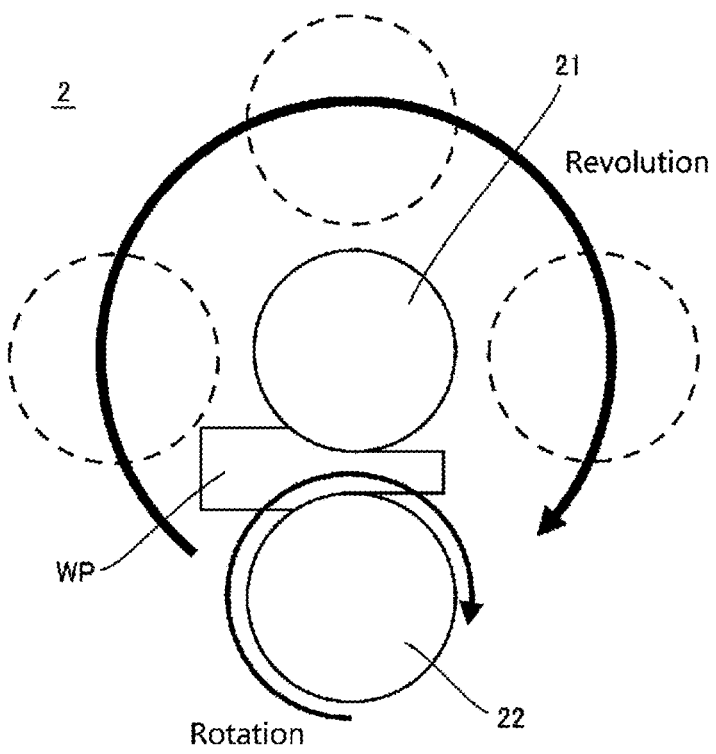
(b)
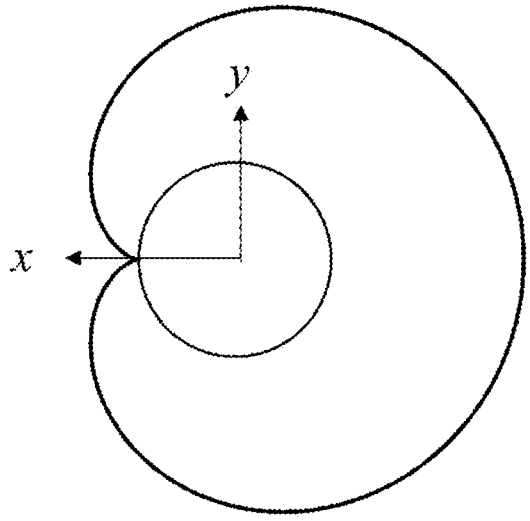

[Fig.2]
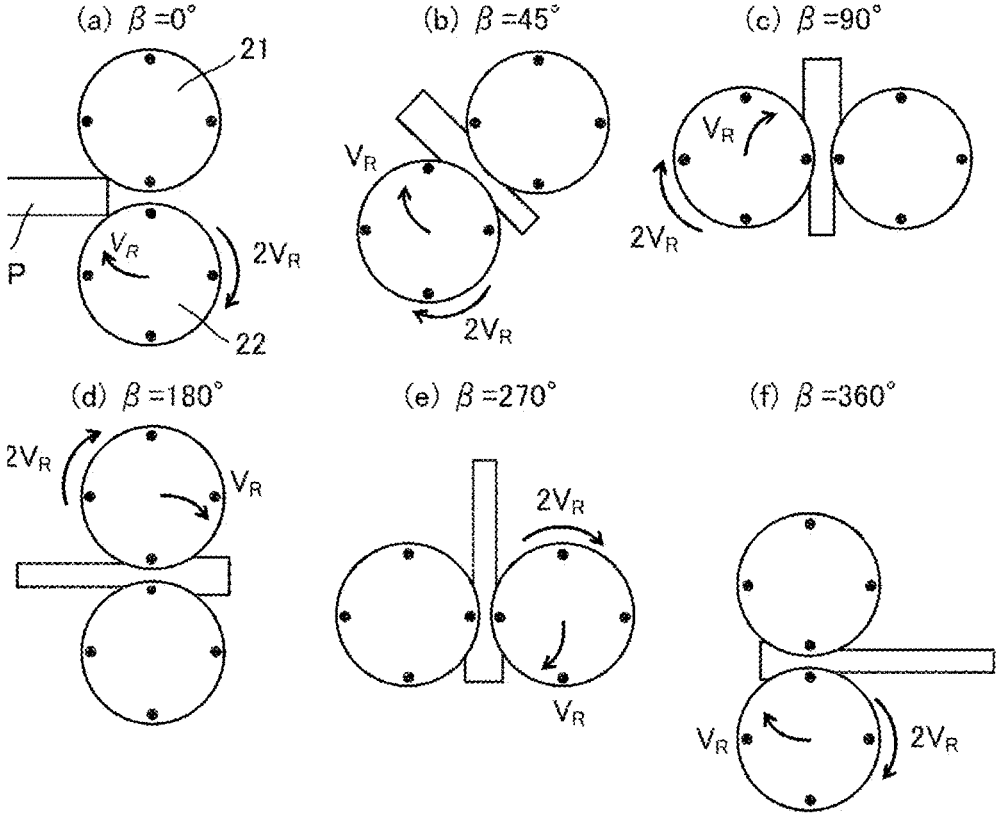

[Fig.3]
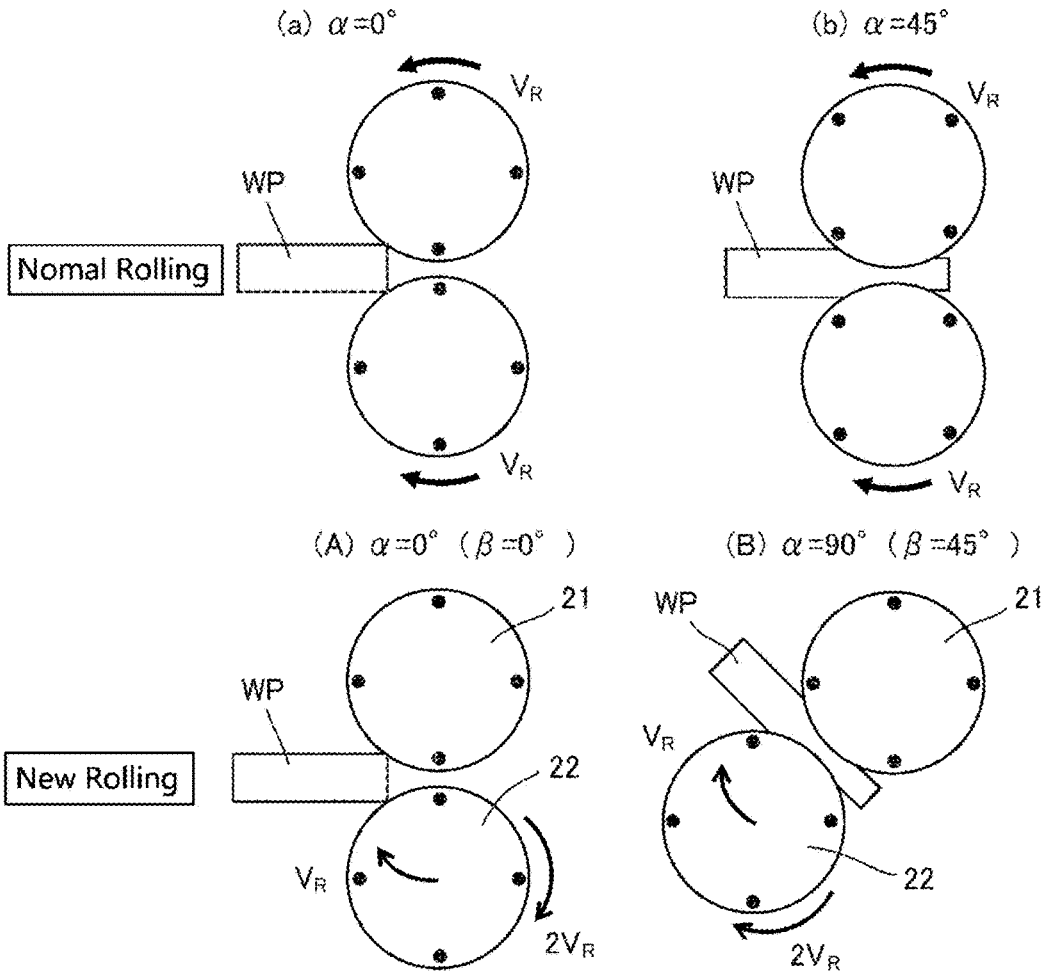
[Fig.4]
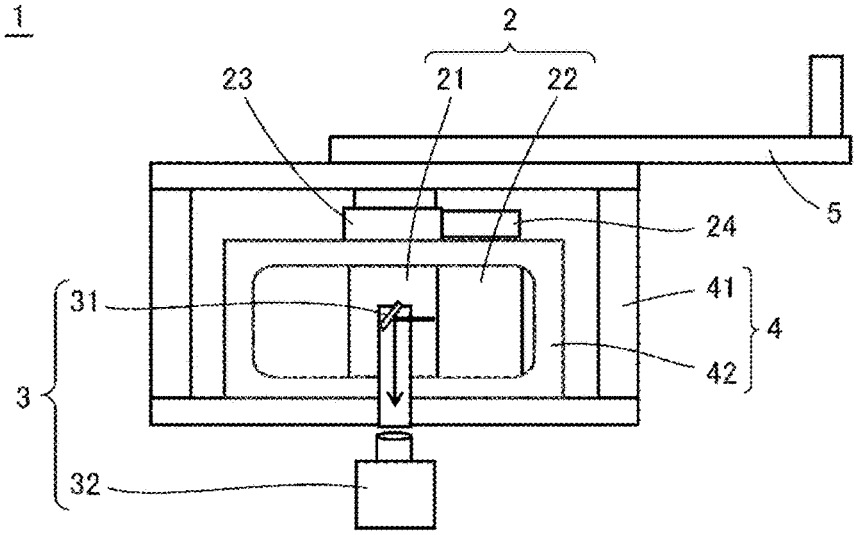

[Fig.5]
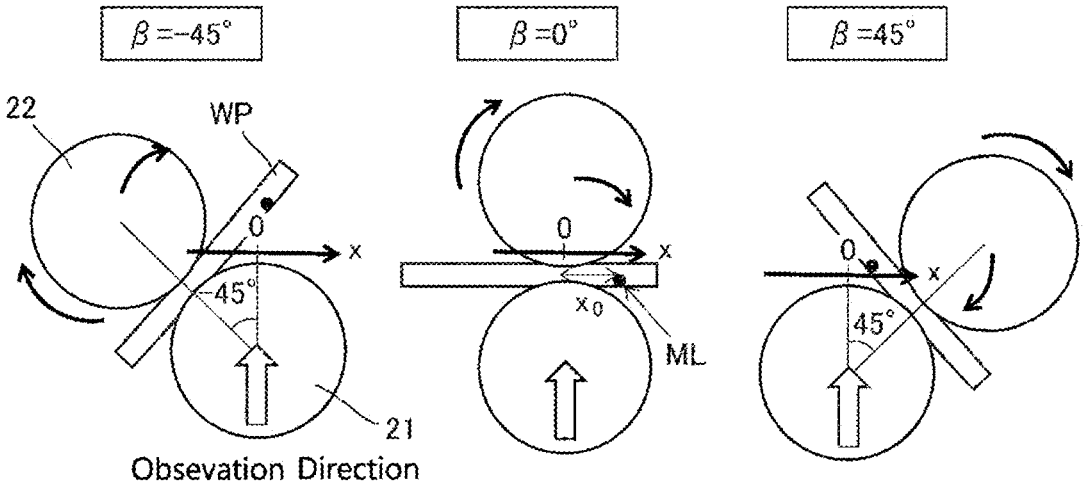
[Fig.6]
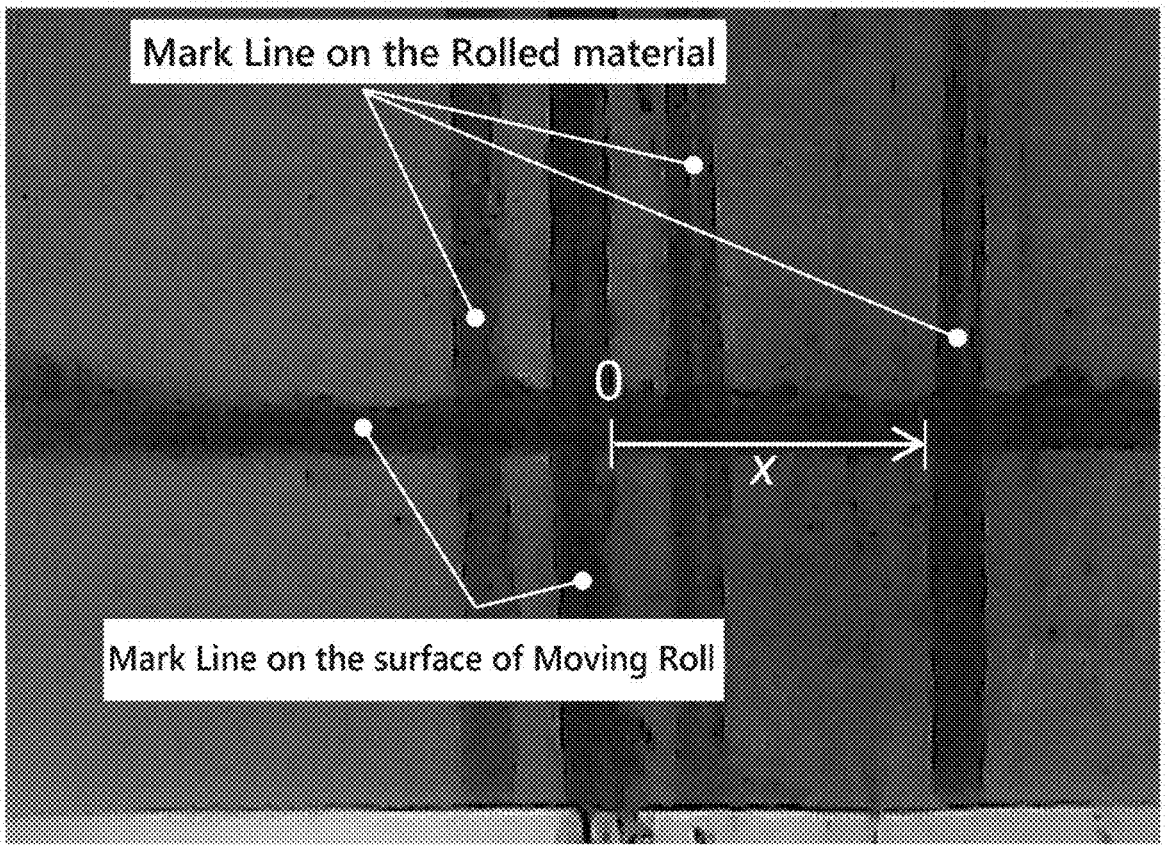

[Fig.7]
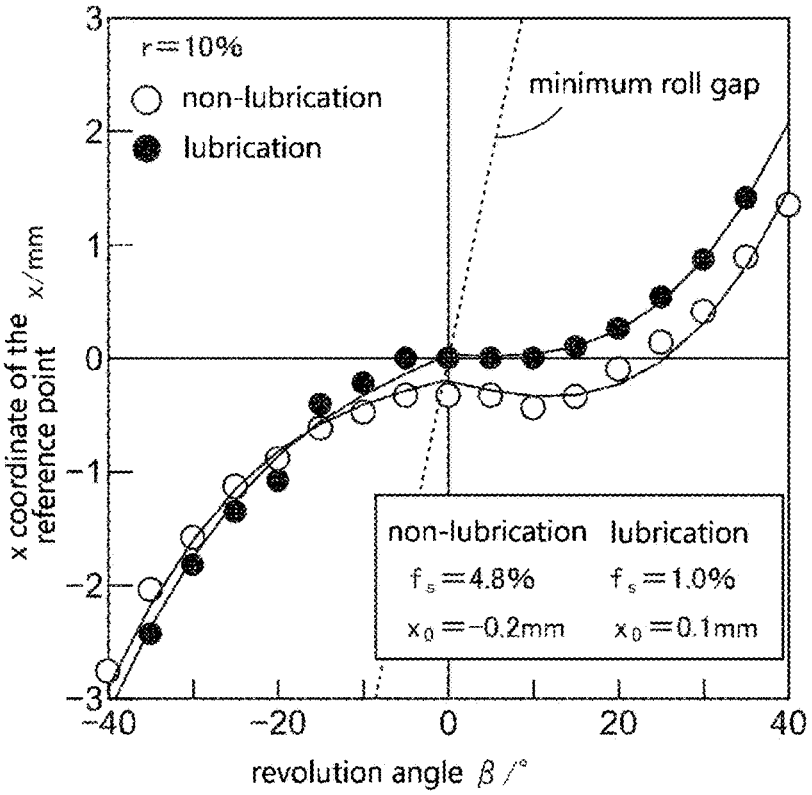
[Fig.8]
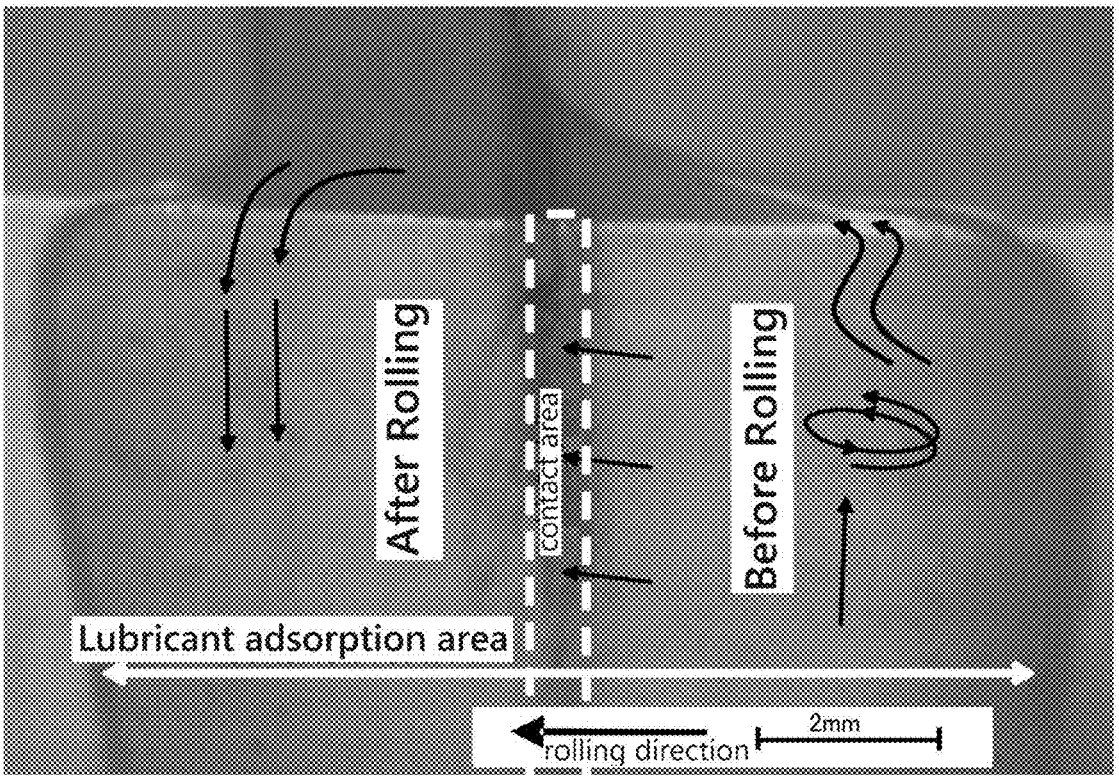

[Fig.9]
(a)
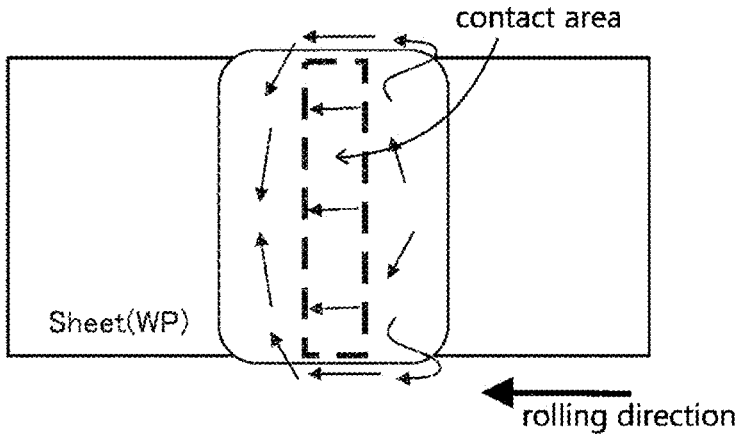
(b)
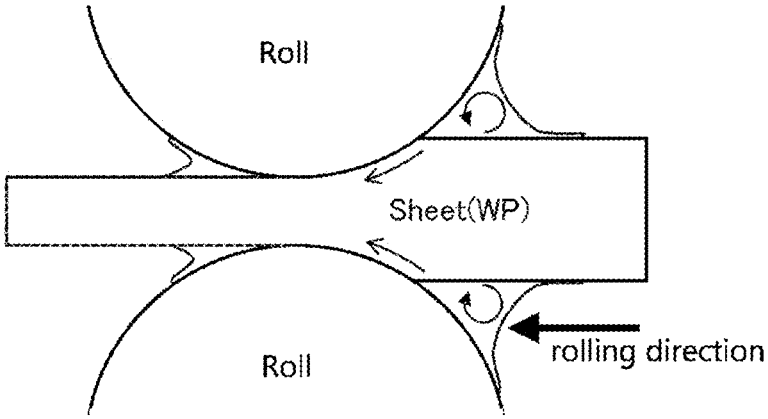

[Fig.10]
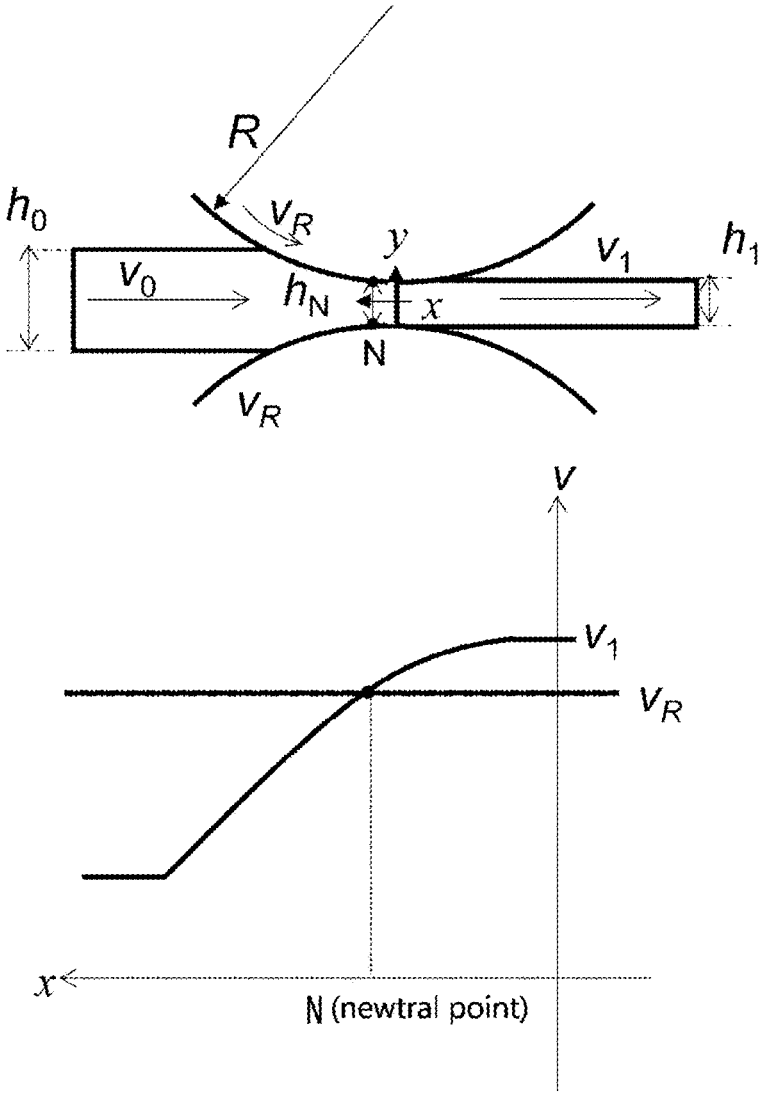

[Fig.11]
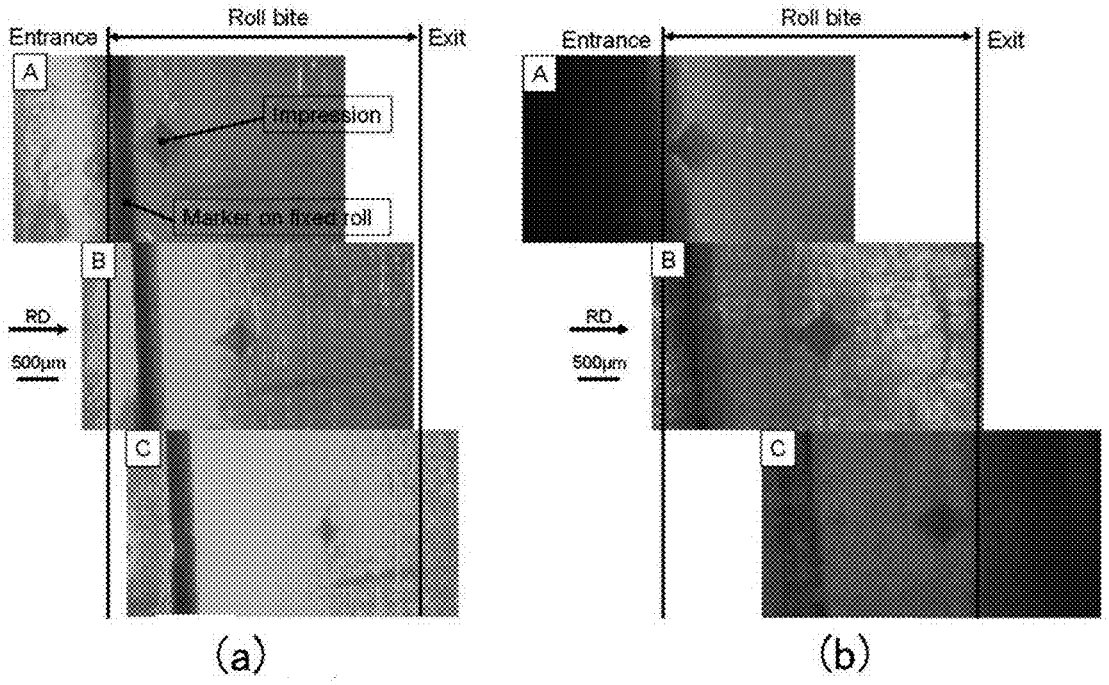
[Fig.12]
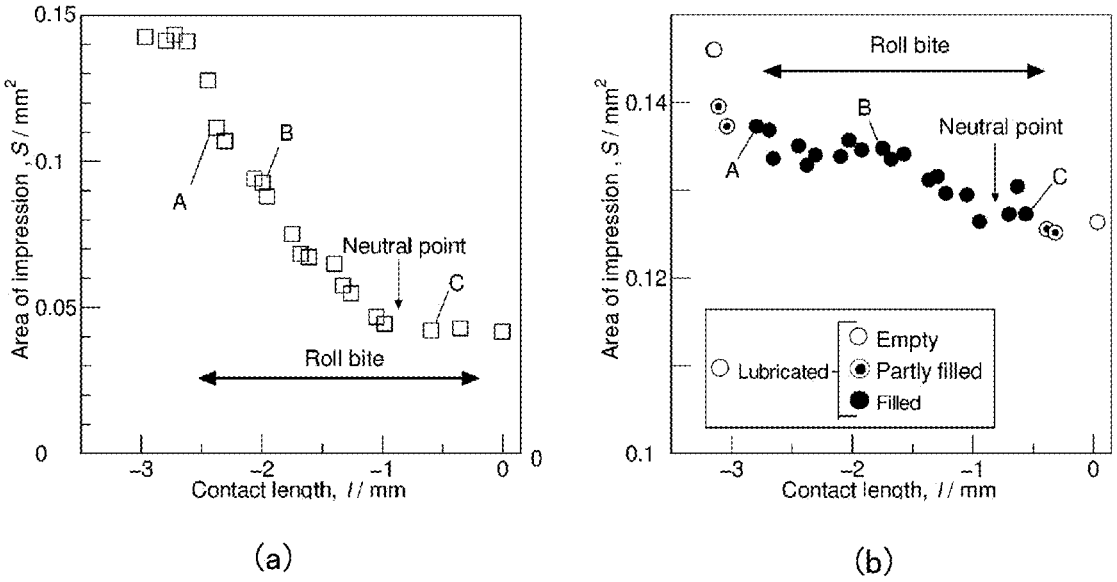

[Fig.13]
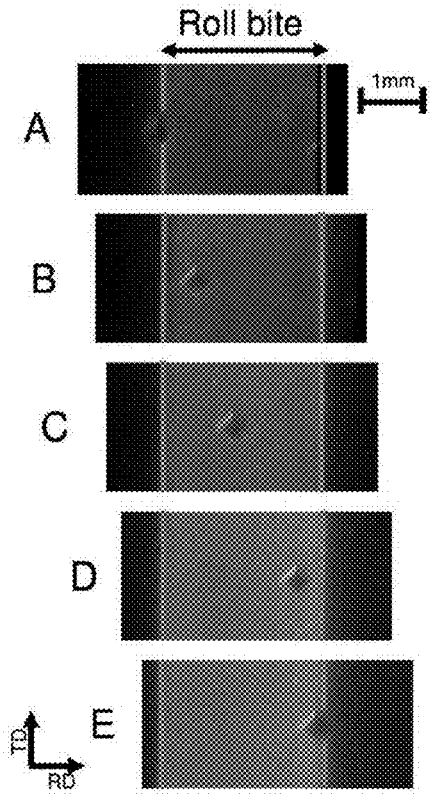
[Fig.14]
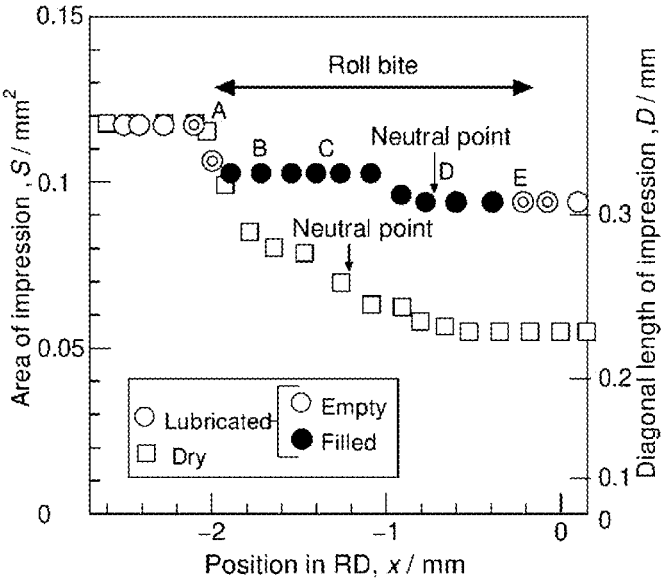

ROLLING STATE OBSERVATION APPARATUS AND ROLLING STATE OBSERVATION METHOD

TECHNICAL FIELD

The present invention relates to a rolling state observation apparatus and a rolling state observation method. More specifically, a rolling state observation apparatus and a rolling state observation method that enable direct in-situ observation of the workpiece deforming on a rolling interface during rolling processes.

BACKGROUND ART

Most of the metallic materials such as plates, sheets, strips, foils, bars, rods, wires, sections, pipes, and tubes are industrially manufactured by rolling. Rolling is a bulk metal forming process in which the thickness of the workpiece is reduced to cause elongation while the length increases with passing the gap between a pair of rolls that rotate in opposite directions to each other. The two rolls can continue to rotate without standing still, so that long materials can be processed continuously at high speed. Therefore, the productivity is high.

Specifically, as shown in FIG. 10, the workpiece enters the roll bite (roll contact region) at a speed $V_0$ that is slower than the peripheral speed of rolls $V_R$ due to the friction forces acting by the rotating rolls, and the thickness decreases from $h_0$ to $h_1$ and elongation occurs before being discharged from the exit of the rolling mill. At this time, the ratio of $V_1$ to $V_R$ is called the forward slip ($V_1/V_R-1$), and the ratio of $V_0$ to $V_R$ is called the backward slip ($1-V_0/V_R$). In general, the high friction coefficient between the rolls and the workpiece, results in high forward slip and backward slip.

Then, when the workpiece passes through the roll bite, there is a neutral point N where the speed of the workpiece and the peripheral speed of rolls coincide on the way and the relative speed is zero. With this neutral point N as the singularity, the relative speed of the workpiece to the peripheral speed of rolls changes direction, and the direction of the frictional shear stress acting on the rolling interface between the roll and workpiece also changes.

For this reason, the deformation of the workpiece on the roll bite and the phenomenon occurring on the interface between the roll and the workpiece are very complicated. It is not easy to elucidate the behavior of the workpiece in the roll bite during rolling.

In addition, in rolling processes, lubricants are generally used in order to reduce rolling load and rolling torque and to obtain rolled materials with a smooth surface. That is, the lubricant is usually in liquid state, and by being drawn into the roll bite due to its viscosity and existing as a film under high pressure on the interface between the roll and the workpiece, the frictional shear force acting on the rolling interface between the roll and the workpiece can be reduced. As a result, the rolling load and rolling torque can be reduced, and a rolled material with a smooth surface can be obtained.

At this time, in order to make the lubricant function effectively and perform appropriate rolling operations, it is important to appropriately select the type of lubricant, additives and viscosity, as well as the amount and method of supply. The film thickness is theoretically expected to depend on the rotational speed of the rolls and the reduction in thickness. However, since the rolls rotate at high speed and the workpiece passes between the rolls at high speed, it is extremely difficult to observe the lubrication state on the rolling interface, and at present, the film thickness of the lubricant is not measured in situ during processing. Hence, selection of lubricant described above largely depends on experience. In addition, it is not easy to measure the surface pressure and shear stress applied on the roll during rolling.

Therefore, it has been proposed that, during conventional rolling, an observation window is provided on the surface of one of the rolls, and the rolling interface during rolling of the aluminum sheet is observed through a reflector installed inside (Patent document 1, Non-patent documents 1 and 2), and that a plasticine sheet made of oil clay is rolled and the rolling interface is observed by installing a camera inside a transparent acrylic roll (Non-Patent Document 3).

PRIOR ART DOCUMENTS

Patent Documents

[Patent document 1] JP 1998-325796 A

Non-Patent Documents

[Non-patent document 1] "Consideration of Lubricant Behavior by Direct Observation of Plate Rolling Interface", Hiroshi Ike, Kunio Tsuji, Makoto Takase: Proceedings of 48th Japanese Joint Conference for the Technology of Plasticity (1997), 315-316.

[Non-patent document 2] "In situ Observation of a Rolling Interface and Modeling of the Surface Texturing of Rolled Sheets", H. Ike, K, Tsuji and M. Takase: Wear, 252(2002), 48-62.

[Non-patent document 3] "Measurement of Streamlines by Direct Observation of the Surface of Plasticine Rolled Plate using Transparent Rolls", Kenichi Yasuda: Proceedings of 66th Japanese Joint Conference for the Technology of Plasticity (1997), 345-346.

SUMMARY OF INVENTION

Problem to be Solved by the Invention

However, since, in each of the conventional techniques described above, observations are being made in a state where the rolls rotate at high speed and the workpiece is passed between the rolls at high speed, it is still not easy to perform in-situ observation of the rolling state on a rolling interface between the workpiece and the rolls.

Accordingly, an objective of the present invention is to provide a rolling observation technique that enables easy in-situ observation of the rolling state on a rolling interface between the workpiece and a roll.

Means for Solving the Problem

The inventors have earnestly studied how to solve the above problems, found that the above problems can be solved by the invention described below, and completed the present invention.

The invention according to claim 1 is a rolling state observation apparatus for observing a rolling state on the rolling interface between the workpiece and a roll when the workpiece is rolled using two rolls, wherein the two rolls are composed of a stationary fixed roll and a moving roll that rotates while revolving around the fixed roll, and a device for observing the rolling state is provided at the fixed roll.

The invention according to claim 2 is the rolling state observation apparatus according to claim 1, which is equipped with a revolving means for revolving the moving roll around the fixed roll with the central axis of the fixed roll as the center of revolution, and a rotating means for rotating the moving roll; and configured to rotate the moving roll by the revolution of the moving roll by the revolution means.

The invention according to claim 3 is the rolling state observation apparatus according to claim 1 or 2, which comprises a fixed frame to which the fixed roll is fixed and a moving frame to which the moving roll is pivotally supported, wherein the moving frame is formed into a double frame structure arranged inside the fixed frame, and the moving frame is rotatably provided around the central axis of the fixed roll, the first gear provided at the rotation center of the moving frame and the second gear provided at the rotation center of the moving roll are arranged so as to mesh with each other, a rotating means for rotating the moving frame and the first gear is provided, the moving roll revolves around the fixed roll in accordance with the rotation of the moving frame, and further the moving roll is configured to rotate by the rotation of the second gear in accordance with the rotation of the first gear that rotates in accordance with the rotation of the moving frame.

The invention according to claim 4 is the rolling state observation apparatus according to any one of claims 1 to 3, wherein the rotation speed of the moving roll is twice the revolution speed.

The invention according to claim 5 is the rolling state observation apparatus according to any one of claims 1 to 4, wherein an observation window for measuring the rolling state on the rolling interface between the workpiece and the roll is provided on the peripheral surface of the fixed roll.

The invention according to claim 6 is the rolling state observation apparatus according to claim 5, wherein the observation window is formed of a light transmitting material.

The invention according to claim 7 is the rolling state observation apparatus according to any one of claims 1 to 4, wherein the fixed roll is formed of a light transmitting material.

The invention according to claim 8 is the rolling state observation apparatus according to claim 6 or 7, wherein the light transmitting material is polycarbonate.

The invention according to claim 9 is the rolling state observation apparatus according to any one of claims 1 to 8, wherein a cylindrical space is provided in the central portion of the fixed roll, and a reflector is provided at a position directly facing the measurement target portion of the cylindrical space at a 45° inclination with respect to the central axis of the fixed roll, an imaging device for photographing a reflection image reflected by the reflector is provided on an extension line of the central axis of the fixed roll; and the rolling state at the rolling interface between the workpiece and the roll is observed by photographing the surface of the workpiece at the measurement target portion via the reflector using the imaging device.

The invention according to claim 10 is the rolling state observation apparatus according to any one of claims 1 to 9, wherein a pressure sensor is provided in the fixed roll, and the rolling state at the rolling interface between the workpiece and the roll is observed by measuring the pressure of the lubricant existing at the rolling interface between the workpiece and the roll using the pressure sensor.

The invention according to claim 11 is the rolling state observation apparatus according to any one of claims 1 to 10, wherein a surface pressure measurement sensor is provided on the surface of the fixed roll, and the rolling state at the rolling interface between the workpiece and the roll is observed by measuring the surface pressure at the rolling interface between the workpiece and the roll using the surface pressure measurement sensor.

The invention according to claim 12 is the rolling state observation apparatus according to any one of claims 1 to 11, wherein a strain gauge or a displacement meter is provided in the fixed roll, and the stress transmission state at the rolling interface between the workpiece and the roll is observed by measuring the deformation of the roll that occurs during the rolling using the strain gauge or the displacement meter.

The invention according to claim 13 is a rolling state observation method for observing a rolling state at the rolling interface between the workpiece and the roll when the workpiece is rolled using the rolling state observation apparatus according to any one of claims 1 to 12, wherein the workpiece material is passed through a gap between the moving roll that rotates while revolving around the fixed roll and the fixed roll while supplying a lubricant, and the rolling state at the rolling interface between the workpiece and the roll is observed using a device for observing the rolling state provided in the fixed roll.

The invention according to claim 14 is a rolling state observation method for observing a rolling state at the rolling interface between the workpiece and the roll when the workpiece is rolled using the rolling status observation apparatus according to claim 3, wherein the moving roll rotates while revolving around the fixed roll via the first gear and the second gear, by rotating the moving frame using the rotating means, and the rolling state at the rolling interface between the workpiece and the roll is observed by an apparatus for observing the rolling state provided in the fixed roll.

Effect of the Invention

According to the present invention, a rolling observation technique that can observe the rolling state at the rolling interface between the workpiece and the roll easily in situ can be provided.

Then, based on the observation results, appropriate rolling conditions, lubricants, and lubrication conditions in the actual rolling process can be easily optimized.

BRIEF DESCRIPTION OF THE DRAWING

FIG. 1 is a diagram conceptually showing the arrangement and movement of the rolls in the rolling state observation apparatus according to one embodiment of the present invention.

FIG. 2 is a diagram showing the movement of the roll and the workpiece when the revolution speed of the moving roll is twice the rotation speed of the moving roll in one embodiment of the present invention.

FIG. 3 is a diagram showing the relationship between the roll and the workpiece in conventional rolling and rolling according to one embodiment of the present invention.

FIG. 4 is a side view schematically showing a specific example of a rolling state observation apparatus according to one embodiment of the present invention.

FIG. 5 is a diagram showing the progress of observation of the rolling state in Example 1.

FIG. 6 is an enlarged photograph showing an example of a still image taken in Example 1.

FIG. 7 is a diagram showing the relationship between the x coordinate of the mark measured in Example 1 and the revolution angle β.

FIG. 8 is an enlarged photograph showing an example of the observation result obtained in Example 1.

FIG. 9 is a diagram schematically showing the flow of lubricant observed in the moving image obtained in Example 1.

FIG. 10 is a diagram illustrating the motions of the roll peripheral surface and the workpiece during rolling in Example 1.

FIG. 11 is a microscope image of an impression observed in situ in Example 2.

FIG. 12 is a diagram showing changes in the impression area in Example 2.

FIG. 13 is a photographed image of the interface under lubricated rolling in Example 3.

FIG. 14 is a diagram showing the relationship between the impression area and the position in the rolling direction (RD) in Example 3.

EMBODIMENTS FOR CARRYING OUT THE INVENTION

Hereinafter, the present invention will be described with reference to the drawings based on the embodiment.

1. Basic Concept of the Present Invention

In considering the solution of the above-described problems, the present inventors break away from the conventional concept that roll rolling is a rolling process in which the workpiece is passed between a pair of rotating rolls. And the present inventors have considered that, if rolling can be performed while one of the rolls is fixed so as not to rotate, a device for observing the rolling state can be easily installed on the fixed roll, and it would be possible to easily observe in situ the rolling state at the rolling interface between the workpiece and the rolls, since the device provided in the fixed roll for observing the rolling state is stationary without rotating during rolling.

However, when a non-rotating roll and a rotating roll are used, the rolling process itself cannot be performed, and, even if it is possible, the rolled workpiece may warp and the behavior between the roll and the workpiece is kinematically completely different from the behavior in conventional rolling process where rolling is performed between rolls rotating in opposite directions at high speed. Hence, it cannot be applied to state observation as is.

Therefore, the present inventor conducted extensive studies using non-rotating rolls and rotating rolls to see if the same behavior as that between the rolls and the workpiece in the conventional rolling process could be reproduced.

As a result, it was found that, when rolling is performed by passing the workpiece while revolving the rotating roll around the non-rotating roll, the relative behavior between the roll and the workpiece is kinetically coincide with the relative behavior between the roll and the workpiece in conventional rolling processing. Thus, the present invention has been completed.

That is, the rolling state observation apparatus (hereinafter simply referred to as "observation apparatus") according to the present invention is a rolling state observation apparatus for observing the rolling state at the rolling interface between the workpiece and the roll when rolling the workpiece to be processed using two rolls, wherein the two rolls are composed of a stationary fixed roll and a moving roll that rotates while revolving around the fixed roll, and a device for observing the rolling state is provided in the fixed roll. Note that rolling using a moving roll that rotates while revolving around a fixed roll can be called geocentric rolling because the moving roll behaves like a celestial body in the geocentric theory.

As described above, when one of the rolls is a fixed roll, various devices for observing the rolling state can be easily provided in the fixed roll, and, since the equipment for observing the rolling state provided in the fixed roll does not rotate during rolling and is stopped, it is easy to observe in-situ the rolling state at the rolling interface between the workpiece and the rolls. Based on the observation results, appropriate rolling conditions in actual rolling processing can be easily optimized.

For example, in the conventional rolling process (hereinafter also referred to as "conventional rolling"), the two rolls are rotated opposite to each other at a constant speed. When, the rotation speed of the moving roll is twice the revolving speed with respect to the stationary fixed roll, the relative motion between the roll and the workpiece can be made to match the relative motion in conventional rolling (uniform speed rolling). Then, by appropriately setting the above-described revolving speed and rotation speed, a cardioid curve (see FIG. 1(*b*)) can be drawn as a trajectory of the moving roll surface point, and the relative motion between the roll and the workpiece can be matched with the relative motion in the conventional rolling process where the speeds of the two rolls are different. When the rotation speed of the moving roll is not twice the revolving speed, the relative motion is a state in which the two rolls rotate at different speeds in the conventional rolling, that is, differential-speed rolling state.

At this time, the observation apparatus is equipped with a revolving means for causing the moving roll to revolve around the fixed roll with the central axis of the fixed roll as the center of rotation, and a rotation means for rotating the moving roll on its own axis. It is preferable that the moving roll is configured to rotate due to the revolution of the moving roll by the revolving means.

With such a configuration, the relationship between the revolution speed and the rotation speed of the moving roll can be easily set to an appropriate relationship, and the moving roll can rotate while revolved around the fixed roll.

2. Embodiment

Hereinafter, embodiments of the present invention will be described.

FIG. 1 is a diagram conceptually showing the arrangement and movement of the rolling roll in the observation apparatus according to the present embodiment; and (a) is a diagram in which the roll is viewed along the axial direction, and (b) shows the trajectory (cardioid curve) of a surface point of the moving roll.

As shown in FIG. 1(*a*), the rolling roll 2 is equipped with one fixed roll 21 and one moving roll 22, and the moving roll 22 is arranged to revolve around the fixed roll 21 while rotating. In FIG. 1(*a*), the moving roll 22 rotates and revolves clockwise, but may be counterclockwise.

Then, the workpiece WP enters the rollbit formed by the gap set between the fixed roll 21 and the moving roll 22, and is rolled while revolving around the fixed roll 21 together with the moving roll 22 revolving around the fixed roll 21.

At this time, by setting the rotation speed of the moving roll 22 to be twice the revolution speed (rotation speed: revolution speed=2:1), as described above, the relative motion between the workpiece and the roll is kinetically matched to the relative motion between the workpiece and the rolls in conventional rolling.

In the present embodiment, the distance between the central axis of the fixed roll 21 and the central axis of the moving roll 22 is appropriately set in consideration of the degree of gap between the rolls, that is, the rolling reduction. Then, by maintaining this interval, by revolving the movable roll 22 around the fixed roll 21 with the central axis of the fixed roll 21 as the revolution center, and by rotating the movable roll 22, the rolling conditions are stabilized and the workpiece can be rolled.

FIG. 2 is a diagram showing the movement of the roll and the workpiece when the rotation speed of the above-described moving roll is twice the revolution speed, and shows how it revolves around the fixed roll 21 once changing the revolution angle $\beta$ of the moving roll 22 from 0° to 360°.

As shown in FIG. 2, it can be seen that the moving roll 22 rotates (rotates on the own axis) twice while making one revolution (revolve around) around the fixed roll 21.

FIG. 3 is a diagram showing the relationship between the roll and the workpiece in the conventional rolling and the roll rolling of the present embodiment. The upper row is a diagram in the conventional rolling, and the lower row is the diagram in the rolling of the present embodiment. $\alpha$ is the rotation angle of the rotating roll.

From FIG. 3, it can be seen that the relationship between the roll and the workpiece when the rotation angle $\alpha$ in conventional rolling is 45° and the relationship between the roll and the workpiece when rotation angle $\alpha$ of rolling in the present embodiment is 90° (revolution angle $\beta$=45°) may be considered kinetically identical.

Since the fixed roll is fixed and does not rotate, it is easy to provide an observation window for measuring the rolling state of the workpiece at the rolling interface on the peripheral surface of the fixed roll.

Since the window is stationary without rotating during rolling, it is possible to easily measure the rolling state of the workpiece at the rolling interface through the observation window from the inside of the fixed roll and to carried out in-situ observation even during rolling.

The observation window is preferably formed of a light transmitting material, but when an observation window is provided, it is necessary to separately provide an optical path from the observation window to the observation apparatus for in-situ observation. In view of this point, it is more preferable to form the entire fixed roll of a light transmitting material instead of providing an observation window so that it is unnecessary to provide an optical path.

As the light transmitting material, glass or quartz may be used, but polycarbonate is preferably used in consideration of machinability and strength.

In order to observe the rolling state at the rolling interface described above, a cylindrical space is provided in the center of the fixed roll, and the reflector is placed directly opposite the measurement target in the cylindrical space at an angle of 45° with respect to the central axis of the fixed roll. Furthermore, it is preferable that an imaging device for photographing the reflected image reflected by the reflector may be provided outside on an extension of the central axis of the fixed roll.

By photographing the surface of the workpiece at the measurement target location through a reflector using an imaging device, the rolling state at the rolling interface between the workpiece and the roll, for example, the rolling state of the workpiece and the behavior of the lubricant on the surface of the workpiece can be easily observed in situ based on the photographed image. As the imaging device, considering that it is necessary to appropriately enlarge the photographed image from the microscopic image for observing the rolling state of the workpiece and the behavior of the lubricant on the surface of the workpiece, an imaging device such as a CCD camera capable of photographing an enlarged image at a magnification of about 100 times is preferable.

The fixed roll may be provided with a pressure sensor. When a pressure sensor is provided in the space at the center of the fixed roll described above, and a flow path leading to the roll surface is provided and the space is filled with lubricant, since the pressure of the lubricant at the rolling interface between the workpiece and the roll can be measured by the pressure sensor, the rolling state at the rolling interface between the workpiece and the roll can be easily observed and the behavior of the lubricant can be known. Note that the pressure sensor may be placed at a location different from the location observed by the imaging device, and in this case, the pressure of the lubricant can be measured simultaneously with observation by the imaging device.

Further, when the surface pressure measurement sensor is installed on the surface of the fixed roll, since the surface pressure measurement sensor can measure the surface pressure on the rolling interface between the workpiece and the roll, the rolling state at the rolling interface between the workpiece and the roll can be observed easily and it is possible to know whether rolling is being performed with an appropriate surface pressure. For measuring the surface pressure, a pressure measuring pin can be mentioned as a surface pressure measurement sensor, but it is also preferable to use a pressure-sensitive paint that changes the degree of color development according to the pressure, and in this case, the degree of surface pressure can be easily and directly known by an extremely simple method of visual inspection. Note that the surface pressure measurement sensor may be placed at a location different from the location observed by the imaging device, and in this case, the surface pressure can be measured simultaneously with observation by the imaging device.

Further, a strain gauge or displacement meter may be provided in the fixed roll, and since the measured strain and displacement are related to the deformation of the roll that occurred during rolling process, the rolling state at the rolling interface between the work material and the roll can be observed easily and it is possible to know whether or not there is any deformation of the roll; and by controlling the deformation, it is possible to improve the shape accuracy of the rolled sheet (workpiece).

Based on these observation results, appropriate rolling conditions in actual rolling process can be easily set.

3. Specific Embodiments

FIG. 4 is a side view schematically showing a specific example of a rolling state observation apparatus according to the present embodiment. In FIG. 4, in-situ observation is performed using the above-described imaging device.

As shown in FIG. 4, the rolling state observation apparatus 1 equips a fixed frame 41 in which the fixed roll 21 is fixed and a moving frame 42 in which the moving roll 22 is pivotally supported. The moving frame 42 is arranged inside the fixed frame 41, and a frame 4 of double structure is formed. Then, the rolling roll 2 is formed by the fixed roll 21 and the moving roll 22.

The moving frame 42 is rotatably provided around the central axis of the fixed roll 21, and the first gear 23 provided at the rotation center of the moving frame 42 and the second gear 24 provided at the rotation center of the moving roll 22 are arranged so as to mesh with each other. And, a handle 5 is provided as a rotating means for rotating the moving frame 42 and the first gear 23.

As such a configuration, by rotating the handle 5 or rotating the motor, the moving frame 42 rotates, and the moving roll 22 pivotally supported on the moving frame 42 revolves around the fixed roll 21. Then, the first gear 23 also rotates according to the rotation of the moving frame 42, and the second gear 24 meshed with the first gear 23 rotates according to the rotation of the first gear 23, thereby the moving roll 22 rotates.

At this time, the revolution speed of the moving roll 22 can be adjusted by appropriately adjusting the rotation speed of the handle 5. Further, by appropriately adjusting the gear ratios of the first gear 23 and the second gear 24, the ratio between the rotation speed and the revolution speed of the moving roll 22 can be adjusted.

The workpiece not shown is rolled by passing the gap between the fixed roll 21 and the moving roll 22 with the sheet width direction as the vertical direction.

The rolling state observation apparatus 1 is further provided with a rolling state observation unit 3 having a reflector 31 and an imaging device 32.

The reflector 31 is provided at a position directly opposite the measurement target location in the cylindrical hole drilled on the central axis of the fixed roll 21 at an angle of 45° with respect to the central axis of the fixed roll. Thereby, the optical path is bent 90° by the reflector, and an image of the rolling interface between the workpiece and the roll can be sent to the image sensor 32 provided on an extension of the central axis outside the fixed roll 21. Then, based on the obtained images and moving images, the rolling state at the rolling interface between the workpiece and the roll, such as, the rolling state of the workpiece and the behavior of the lubricant on the surface of the workpiece can be easily observed. The shape of the cylindrical hole is not limited, and may be any shape, such as a quadrangular prism shape and a cylindrical shape. Further, the position at which the imaging device is provided may be outside the fixed roll as long as it is on the extension line of the central axis of the fixed roll. Thereby, not limited to a small imaging device such as an endoscope, but a large camera can be used to photograph in high resolution.

In the above, in-situ observation of the rolling state at the rolling interface between the workpiece and the roll using an imaging device is described as an example, but by appropriately arranging a pressure sensor, strain gauge, or displacement meter, the rolling state at the rolling interface between the workpiece and the roll can be easily observed similarly.

Further, in the rolling state observation apparatus according to the present embodiment, the arrangement of the moving roll and the fixed roll is not limited to the left and right arrangements as shown in FIG. 4, but may be arranged above and below.

As described above, according to the present embodiment, since the rolling state at the rolling interface between the workpiece and the roll can be easily observed in situ, appropriate rolling conditions and lubrication conditions in actual rolling processing can be easily set based on the observation results.

EXAMPLE

Hereinafter, the present invention will be described more specifically based on examples.

Example 1

1. Rolling State Observation Apparatus

In this example, the observation apparatus shown in FIG. 4 was assembled using two rolls (diameter 40 mm×body length 55 mm) made of polycarbonate, one of which was a fixed roll and the other was a moving roll. As the imaging device, a CCD camera "USB MICRSCOPE UM12" (30 fps, 5 million pixels) manufactured by Microlinx was used.

2. Rolling

As the rolled material to be processed, Sn-40% Pb sheet having a thickness of 0.5 mm×width of 15 mm×and a length of 50 mm was used, and was entered into an observation apparatus so that the rolled material was erected, that is, the sheet width direction was the vertical direction, and rolling was performed at a reduction in thickness of 10% under two conditions of lubrication and non-lubrication. Under lubrication conditions, CU50 manufactured by Idemitsu Kosan Co., Ltd. (mineral oil-based rolled oil for non-ferrous metals: kinematic viscosity 7.411 $mm^2/s$, density 0.8587 $g/cm^3$) was used as a lubricant.

3. Observation

In this example, specific observation was performed for observation of the trajectory of the mark line attached to the rolled material and in situ observation of lubrication rolling.

(1) Observation of the Trajectory of the Mark Line Attached to the Rolled Material FIG. 5 is a diagram showing the progress of observation of the rolling state performed during this rolling. A mark line parallel to the sheet width direction is marked in advance on the surface of the rolled material, and the trajectory of the point (reference point) of the mark line ML that moves by rolling that appeared on the cross section in the width direction of the rolled material was observed from the direction indicated by the white thick arrow.

Specifically, as shown in FIG. 5, the x-axis is set in the rolling direction and in the horizontal direction of the camera image, and the revolution angle β is changed from −45° to 45° in 5° increments to take a still image (an example of which is shown in FIG. 6), and the x-coordinate of the reference point (mark line) was measured. The x coordinate of the reference point (mark line) when the revolution angle β=0° is $x_0$.

FIG. 7 is a diagram showing the relationship between the x coordinate of the reference point (mark line) and the revolution angle β. In FIG. 7, the circle is a measured value, and the dotted line represents the x coordinate of the minimum roll gap position.

From FIG. 7, it can be seen that, since the rolled material also rotates as the moving roll revolves (the revolution angle β increases), the x coordinate of the reference point (mark line) changes from a negative value to a positive value, the mark line passes through the minimum roll gap around β=0°, and the slope of the trajectory becomes gentler.

Then, the following formula could be obtained by vector analysis for the trajectory x shown in FIG. 7 in consideration of the forward slip $f_s$.

$$x = R\sin\beta - R\left\{\beta - \frac{x_0}{R(1+f_s)}\right\}(1+f_s)\cos\beta \quad \text{[Formula 1]}$$

$f_s$: *advabced* rate $x_0$: $x$ coordinate when $\beta = 0$ $R$: roll radius $\beta$: revolution angle Then, using this formula as a theoretical formula, $f_s$ and $x_0$ can be obtained by fitting with the experimental value using the least squares method. In the example shown in FIG. 7, in the case of no lubrication, $f_s$=4.8%, $x_0$=−0.2 mm, while in the case of lubrication, $f_s$=1.0%, $x_0$=0.1 mm, and it was confirmed that even in the observation apparatus of the present invention, using a lubricant, the forward slip reduces, that is, the friction coefficient reduces. FIG. 7 also shows a regression line based on the above formula as a solid line.

Further, when the friction coefficient was calculated from the relational expression between the friction coefficient and the forward slip, specifically from the Brand and Ford formula, the friction coefficient in the case of no lubrication was 0.19, while the friction coefficient in the case of lubrication was 0.02, and it was confirmed that the coefficient of friction was reduced by using a lubricant in the observation apparatus of the present invention as well.

As described above, by observing the rolling state at the rolling interface between the workpiece and the roll using the observation apparatus of the present invention, it has been found that the same behavior as the behavior between the roll and the workpiece in the conventional rolling process can be confirmed. Then, by observing the trajectory of the mark line attached on the surface of the workpiece (rolled material) using the observation apparatus of the present invention, the forward slip and friction coefficient can be determined, and it was confirmed that the role of the lubricant was fulfilled as theoretical.

(2) In-Situ Observation of Lubrication Rolling (Observation of Lubricant Flow)

Next, under the conditions of a rolling reduction of 4%, an image of the rolling interface near the sheet edge of the lubricated rolling was taken, and the behavior of the lubricant at the rolling interface was observed. In order to visualize the flow of the lubricant, the lubricant was mixed with crushed charcoal powder.

FIG. 8 shows the observation results. The portion observed in dark color is the portion where the lubricant is adsorbed on the surface of the rolled material, and this portion moves as it revolves. The area surrounded by a dashed line indicates the contact area (roll bite) obtained from the minimum roll gap position and the geometrically obtained contact length of 0.4 mm. In FIG. 8, a thin arrow indicates the direction in which the lubricant flows.

From FIG. 8, it can be seen that the lubricant thinly covers the rolling interface in the contact area. The lubricant is also found in a wider range than the contact area, which is thought to be because the lubricant is adsorbed to the rolled material.

Then, FIG. 9 schematically shows the flow of lubricant observed in the moving image. Note that (a) is a diagram of the rolling interface viewed from the front, and (b) is a diagram viewed in the axial direction of the roll.

From FIG. 9, it can be seen that, at the roll bite inlet, the lubricant that was not drawn in is discharged sideward from the sheet edge. Then, on the roll bite outlet side, it can be seen that the lubricant is reflowing in from the side. Further, on the roll bite inlet side, it can be seen that the lubricant that was not taken into the contact area is swirling and flowing back. This vortex seems to have been caused by the difference between the peripheral speed of roll at the roll inlet and the entry speed of the rolled material.

Example 2

In this example, the behavior of the lubricant at the rolling interface was observed in more detail.

Specifically, Vickers hardness impressions (square pyramid shape having a diagonal length of 519 μm) were made along the rolling direction in advance near the center of the sheet width of the rolled surface of the Sn-40% Pb sheet material having a width of 10 mm, a length of 50 mm, and a thickness of 0.5 mm to prepare a workpiece. Using the workpiece, rolling was carried out under two conditions, lubrication and non-lubrication, at a circumferential speed of 0.19 m/min and a rolling reduction of 15%, and the changes of impression areas before and after rolling was measured.

For observation, a square prism-shaped hole was provided in the longitudinal direction inside the fixed roll and a reflector inclined to 45° with respect to the rolling interface was installed, so that an image of the rolling interface seen from the inside of the roll was observed in situ using a microscope installed at the bottom. As the lubricant, a paraffinic rolled oil (kinematic viscosity: 7.7 $mm^2/s$) to which a colorant was added to improve visibility was used.

FIG. 11 is a microscopic image of an impression observed in situ. In FIG. 11, (a) is an image without lubrication and (b) is an image under lubrication conditions, and images of impression A: near the roll bite inlet, B: the roll bite intermediate point, and C: the near the roll bite outlet, in order from top to bottom, are shown. The vertical lines in the image are mark lines marked on the surface of the fixed roll.

From FIG. 11, it can be seen that in both lubricated and non-lubricated cases, the impression area is reduced by rolling, but the reduction in thickness is larger in the case without lubrication.

FIG. 12 is a diagram showing a change in the impression area, and (a) is the result of non-lubricated case and (b) is the result of lubricated case. In FIG. 12, the vertical axis is the impression area ($mm^2$), the horizontal axis is the coordinates (mm) of the rolling direction with the roll outlet as the origin. The impression area is determined from pixel counts obtained using image editing software: GIMP 2.10.28 to the observation image shown in FIG. 11. In FIG. 12, the bidirectional arrows indicate the range of the roll bite, and the vertical down arrows indicate the positions of the neutral points obtained from the respective forward slips $f_s$ (non-lubricated: 1.5%, lubricated: 0.8%). In addition, the outline symbol indicates that there is no lubricant in the impression, the black color symbol indicates that the impression is filled with lubricant, and the double circle indicates that the impression is partially outside the roll bite From FIG. 12, it can be seen that the impression area, which was 0.143 $mm^2$ before rolling before the roll bite inlet, is reduced by 71% to 0.042 $mm^2$ in non-lubricated rolling (see FIG. 12A), while it remains 13% reduction to 0.125 $mm^2$ in lubricated rolling (see FIG. 12B). And it can be seen that the impression area is monotonically reduced in non-lubricated rolling, but a two-step change is shown in lubricated rolling.

That is, when the impression reaches the inlet of the roll bite, the impression area shows a remarkable decrease, and the impression area does not change from point A, which is considered that the impression has completely entered the roll bite and the mechanical seal has been achieved. It begins to decrease again from point B, which is about 1 mm upstream from neutral point, and continues to decrease until the neutral point. After the neutral point, the impression area is 0.135 $mm^2$ and becomes a substantially constant area of 0.135 $mm^2$ that does not change and is discharged from the outlet of the roll bite. The decrease in the impression area at point B means that the hydrostatic pressure of the trapped lubricant increased due to the increase in rolling pressure and seeped into the rolling interface. It is considered that there was no change in the impression area, since the rolling pressure decreases after the neutral point.

Example 3

In this example, rolling was performed in the same manner as in Example 2 except that the impression was a square pyramid shape having a diagonal length of 485 μm, the roll rotation speed was 3.3 rpm, and the rolling reduction was 10%. The behavior of the lubricant at the rolling interface was observed. Note that a digital camera (Nikon D7500) was used to take the observation images, and the images were taken as FHD (1920×1080 pixels) videos at 60 frames per second.

The impression area was then determined by measuring the diagonal length of the impression. As a result, it was found that the impression area in front of the roll bite inlet, which was 0.117 $mm^2$ before rolling, was 0.055 $mm^2$ in non-lubricated rolling and 0.094 $mm^2$ in lubricated rolling (see FIG. 14). This result indicates that the lubricant within the impression suppresses the closure of the impression due to the low compressibility of the lubricant.

FIG. 13 is a photographed image of an interface under lubrication rolling.

Note that, in actual rolling, the rolling direction is oriented from left to right, and the position of the minimum roll gap moves slightly to the upstream side during rolling, but in FIG. 13, the rolling direction is reversed by 180 degrees to have the same image as rolling in a normal roll, and the positions of the minimum roll gaps of images A to E are made to match.

In FIG. 13, the region sandwiched between the two lines at both ends of the roll bite is a region where the workpiece and the fixed roll are in contact, and at the interface, the lubricant film thickness is thin enough to be ignored except for the impression portion. The other parts are areas where the workpiece and the roll are not in contact, and the color is dark because the lubricant remains.)

In FIG. 13, in A, the impression is located at the inlet of the roll bite, and in B, the impression completely enters the roll bite, so it can be seen that the lubricant is trapped in the impression when the impression comes into contact with the roll. Also, in A, the size of the impression is slightly reduced.

On the other hand, in D, the size of the impression is greatly reduced. In E, it can be seen that the front end portion of the impression has passed through the minimum roll gap, the pressure on the lubricant is removed, and the lubricant flows out of the impression toward the downstream side.

FIG. 14 is a diagram showing the relationship between the impression area and the position in the rolling direction (RD), where the vertical axis is the impression area ($mm^2$) and the horizontal axis is the coordinates (mm) of RD. On the horizontal axis, the position of the minimum roll gap is set to 0. A black-out mark indicates that the impression is filled with lubricant, and a open symbol indicates that the impression is empty. Also, a double mark indicates that the impression is partially coming out of the roll bite. Also, a bidirectional arrow indicates the range of the roll bite, and a down arrow indicates the position of the neutral point. Note that A~E in FIG. 14 corresponds to A~E in FIG. 13.

In the case of non-lubricated rolling, the impression area is monotonically reduced in the roll bite. This trend is similar to the reduction in thickness of the workpiece. On the other hand, in the case of lubricated rolling, the change in the impression area is small after the impression enters the roll bite, as in step B. Then, just before the neutral point, the decline begins again, and after the neutral point, the change becomes smaller. Then, the reduction starts again just before the neutral point, and the change becomes smaller after passing the neutral point. Finally, at the outlet of the roll bite, the lubricant is flowing out of the impression. These observations indicate that the reduction in the impression area again before stage D is due to the lubricant trapped in the impression leaking out of the impression due to the increased pressure.

These observation results described above were obtained for the first time by observing the rolling state at the rolling interface between the workpiece and the roll using the observation apparatus of the present invention.

Then, by using a camera with a higher magnification for observation, it is possible to observe in situ the leakage of lubricant from the naturally formed pit in addition to artificially formed impressions. In addition, by electrifying the drive of the roll, it is possible to clarify the influence of the rolling speed. In addition, by adopting a steel roll and providing a small observation window made of quartz, it is possible to observe in situ even when actually performing rolling work.

As described above, although the present invention has been described based on the embodiment, the present invention is not limited to the above embodiment. Within the same and equivalent scope as the present invention, various modifications can be made to the embodiments described above.

DESCRIPTION OF REFERENCE SIGNS

1 Rolling state observation apparatus
2 Rolling roll
3 Rolling state observation unit
4 Double structure frame
5 Handle
21 Fixed roll
22 Moving roll
23 First gear
24 Second gear

31 Reflector
32 Image sensors
41 Fixed frame
42 Moving frame
$h_0$ Thickness of workpiece before entering
$h_1$ Thickness of workpiece at discharge
$h_N$ Thickness of the workpiece at the neutral point
N Neutral point
R Roll radius
$V_0$ Workpiece entry speed
$V_1$ Workpiece discharge speed
$V_R$ Peripheral speed of roll (revolution speed)
WP Workpiece
α Rotation angle
β Revolution angle

What is claimed is:

1. A rolling state observation apparatus for observing a rolling state at the rolling interface between a workpiece and two rolls when the workpiece is rolled using the two rolls, comprising:

the two rolls, which are a stationary fixed roll and a moving roll that rotates while revolving around the fixed roll, and a device for observing the rolling state that is provided at the fixed roll.

2. The rolling state observation apparatus according to claim 1, which is equipped with a revolving means for revolving the moving roll around the fixed roll with the central axis of the fixed roll as the center of revolution, and a rotating means for rotating the moving roll; and configured to rotate the moving roll by the revolution of the moving roll by the revolution means.

3. The rolling state observation apparatus according to claim 1, further comprising a fixed frame to which the fixed roll is fixed and a moving frame to which the moving roll is pivotally supported, wherein the moving frame and the fixed frame makes up the double structure, and the moving frame is rotatably provided around the central axis of the fixed roll, a first gear provided at the rotation center of the moving frame and a second gear provided at the rotation center of the moving roll are arranged so as to mesh with each other, a rotating means for rotating the moving frame and the first gear is provided, the moving roll revolves around the fixed roll in accordance with the rotation of the moving frame, and further the moving roll is configured to rotate by the rotation of the second gear in accordance with the rotation of the first gear that rotates in accordance with the rotation of the moving frame.

4. The rolling state observation apparatus according to claim 1, wherein the rotation speed of the moving roll is twice the revolution speed.

5. The rolling state observation apparatus according to claim 1, wherein an observation window for measuring the rolling state at the rolling interface between the workpiece and the roll is provided on the peripheral surface of the fixed roll.

6. The rolling state observation apparatus according to claim 5, wherein the observation window is formed of a light transmitting material.

7. The rolling state observation apparatus according to claim 1, wherein the fixed roll is formed of a light transmitting material.

8. The rolling state observation apparatus according to claim 6, wherein the light transmitting material is polycarbonate.

9. The rolling state observation apparatus according to claim 1, wherein a cylindrical space is provided in the central portion of the fixed roll, and a reflector is provided at a position directly facing a measurement target portion of the cylindrical space at a 45° inclination with respect to the central axis of the fixed roll, an imaging device for photographing a reflection image reflected by the reflector is provided on an extension line of the central axis of the fixed roll; and the rolling state at the rolling interface between the workpiece and the roll is observed by photographing the surface of the workpiece at the measurement target portion via the reflector using the imaging device.

10. The rolling state observation apparatus according to claim 1, wherein a pressure sensor is provided in the fixed roll, and the rolling state at the rolling interface between the workpiece and the roll is observed by measuring the pressure of the lubricant existing at the rolling interface between the workpiece and the roll using the pressure sensor.

11. The rolling state observation apparatus according to claim 1, wherein a surface pressure measurement sensor is provided on the surface of the fixed roll, and the rolling state at the rolling interface between the workpiece and the roll is observed by measuring the surface pressure at the rolling interface between the workpiece and the roll using the surface pressure measurement sensor.

12. The rolling state observation apparatus according to claim 1, wherein a strain gauge or a displacement meter is provided in the fixed roll, and a stress transmission state at the rolling interface between the workpiece and the roll is observed by measuring the deformation of the roll that occurs during the rolling using the strain gauge or the displacement meter.

13. A rolling state observation method for observing a rolling state at the rolling interface between the workpiece and the roll when the workpiece is rolled using the rolling state observation apparatus according to claim 1, wherein the workpiece material is passed through a gap between the moving roll that rotates while revolving around the fixed roll and the fixed roll while supplying a lubricant, and the rolling state at the rolling interface between the workpiece and the roll is observed using a device for observing the rolling state provided in the fixed roll.

14. A rolling state observation method for observing a rolling state at the rolling interface between the workpiece and the roll when the workpiece is rolled using the rolling status observation apparatus according to claim 3, wherein the moving roll rotates while revolving around the fixed roll via the first gear and the second gear, by rotating the moving frame using the rotating means, and the rolling state at the rolling interface between the workpiece and the roll is observed by the device for observing the rolling state provided in the fixed roll.

15. The rolling state observation apparatus according to claim 2, which comprises a fixed frame to which the fixed roll is fixed and a moving frame to which the moving roll is pivotally supported, wherein the moving frame and the fixed frame makes up the a double structure, and the moving frame is rotatably provided around the central axis of the fixed roll, a first gear provided at the rotation center of the moving frame and a second gear provided at the rotation center of the moving roll are arranged so as to mesh with each other, a rotating means for rotating the moving frame and the first gear is provided, the moving roll revolves around the fixed roll in accordance with the rotation of the moving frame, and further the moving roll is configured to rotate by the rotation of the second gear in accordance with the rotation of the first gear that rotates in accordance with the rotation of the moving frame.

16. The rolling state observation apparatus according to claim 2, wherein the rotation speed of the moving roll is twice the revolution speed.

17. The rolling state observation apparatus according to claim 3, wherein the rotation speed of the moving roll is twice the revolution speed.

18. The rolling state observation apparatus according to claim 2, wherein an observation window for measuring the rolling state at the rolling interface between the workpiece and the roll is provided on the peripheral surface of the fixed roll.

19. The rolling state observation apparatus according to claim 3, wherein an observation window for measuring the rolling state at the rolling interface between the workpiece and the roll is provided on the peripheral surface of the fixed roll.

20. The rolling state observation apparatus according to claim 4, wherein an observation window for measuring the rolling state at the rolling interface between the workpiece and the roll is provided on the peripheral surface of the fixed roll.

* * * * *